United States Patent [19]

Horst, Sr. et al.

[11] Patent Number: 4,518,847

[45] Date of Patent: May 21, 1985

[54] ELECTRICALLY-POWERED PORTABLE SPACE HEATER

[75] Inventors: Paul V. Horst, Sr., Boulder; Charles D. Hoyt, Northglenn, both of Colo.

[73] Assignee: Crockett & Kelly, Inc., Broomfield, Colo.

[21] Appl. No.: 438,593

[22] Filed: Nov. 2, 1982

[51] Int. Cl.[3] ..... H05B 1/02; F24H 3/08; F24D 13/04

[52] U.S. Cl. ..... 219/365; 126/101; 219/341; 219/342; 219/364; 219/367; 219/368; 219/370; 237/16; 237/79

[58] Field of Search ..... 219/341, 364, 365–368, 219/369, 370, 342; 237/79, 16–18; 126/101

[56] References Cited

U.S. PATENT DOCUMENTS

| | | | |
|---|---|---|---|
| 1,043,922 | 11/1912 | Gold | 219/341 X |
| 1,289,052 | 12/1918 | Allensby . | |
| 1,866,221 | 7/1932 | Pennington | 219/341 |
| 1,913,923 | 6/1933 | Freeman . | |
| 1,919,204 | 7/1933 | Decker . | |
| 1,983,437 | 12/1934 | Carr . | |
| 2,276,407 | 3/1942 | Manzer | 219/341 X |
| 2,432,917 | 12/1947 | Mauer . | |
| 2,481,963 | 9/1949 | Witte et al. | 219/364 |
| 2,492,774 | 12/1949 | Wild | 219/364 |
| 2,509,138 | 5/1950 | Dorn . | |
| 2,594,101 | 4/1952 | Volker | 219/370 |
| 2,765,393 | 10/1956 | Theisen | 219/364 |
| 2,772,342 | 11/1956 | Reynolds et al. . | |
| 2,866,073 | 12/1958 | Omohundro | 219/370 X |
| 3,179,788 | 4/1965 | Uhlig | 219/341 |
| 3,271,546 | 9/1966 | Chesnut | 219/363 X |
| 3,281,574 | 10/1966 | Heiman | 219/341 |
| 3,337,715 | 8/1967 | Finn | 219/364 X |
| 3,463,904 | 8/1969 | Pauls | 219/341 |
| 3,469,075 | 9/1969 | Barbier | 219/341 |
| 3,523,180 | 8/1970 | Kennedy | 219/367 |
| 3,640,456 | 2/1972 | Sturgis | 237/16 X |
| 3,927,299 | 12/1975 | Sturgis | 219/341 X |
| 3,941,311 | 3/1976 | McNeely | 219/341 X |
| 4,223,205 | 5/1978 | Sturgis | 219/365 |

*Primary Examiner*—A. Bartis

*Attorney, Agent, or Firm*—Edwin L. Spangler, Jr.

[57] ABSTRACT

A portable electrically-powered space heater includes an electrically-powered boiler generating steam at sub-atmospheric pressure from a mixture of water and ethylene glycol that is circulated through a closed loop heat exchanger, portions of which comprise fin-tube radiators. The boiler is thermostatically controlled by a thermostat located in a chimney into which a downdraft of ambient air is drawn by a fan creating a forced-flow of air over the fin tubes. An automatic temperature-responsive time delay mechanism allows the boiler to get up to its operating temperature before the fan is actuated to draw air across the thermostat. The heater is further characterized by a novel design wherein a pair of upstanding heat exchangers are each housed in branches of a generally Y-shaped housing with a fan located in the stem-forming portion thereof effective to cooperate with the heat exchangers and the double-walled side panels alongside thereof to distribute a curtain of warm air over a 90° or better swath.

6 Claims, 10 Drawing Figures

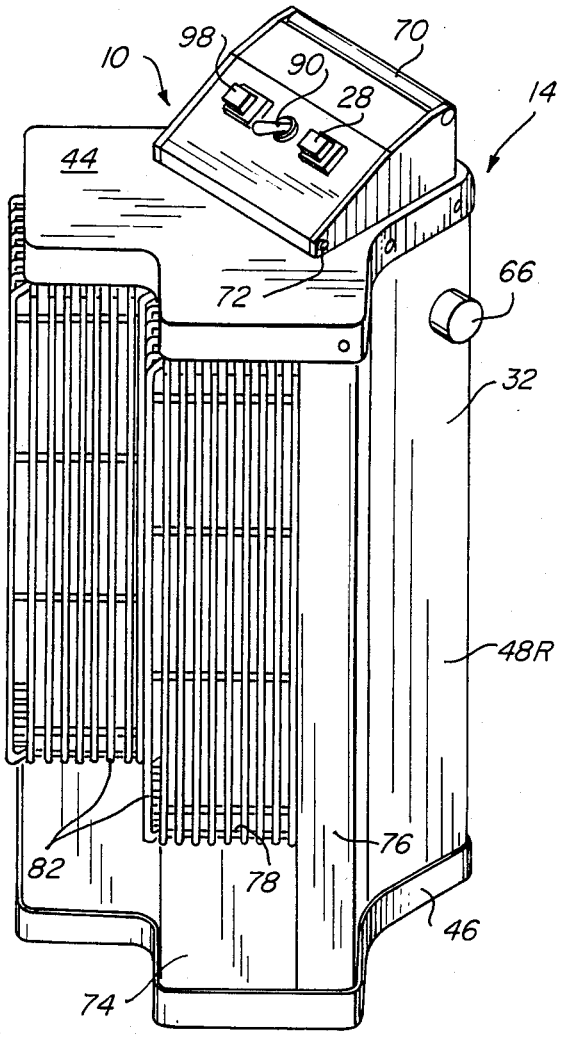
Fig.-1
Fig.-2
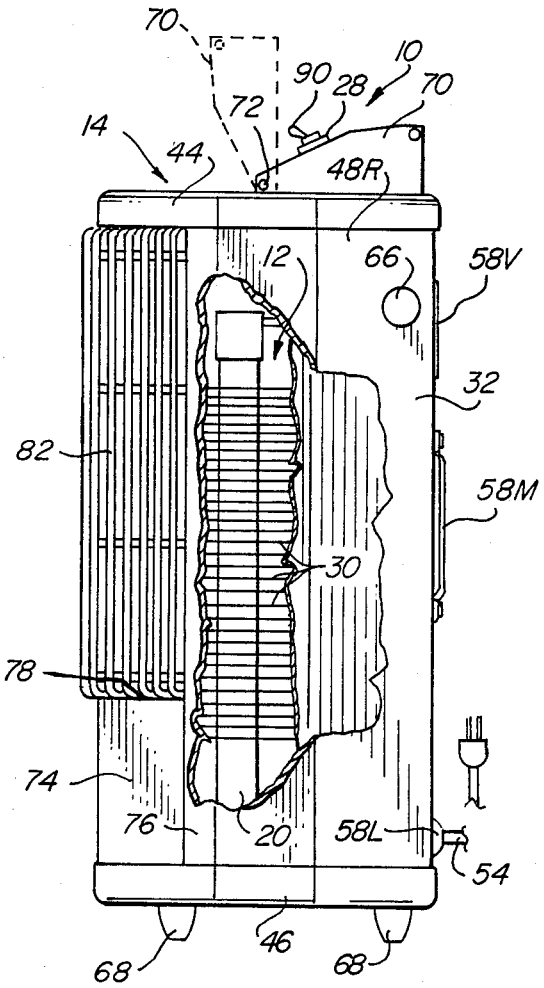
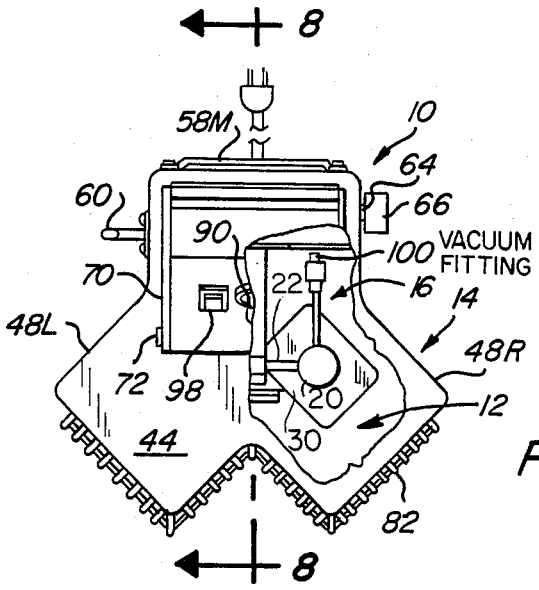
Fig.-3

Fig.-10
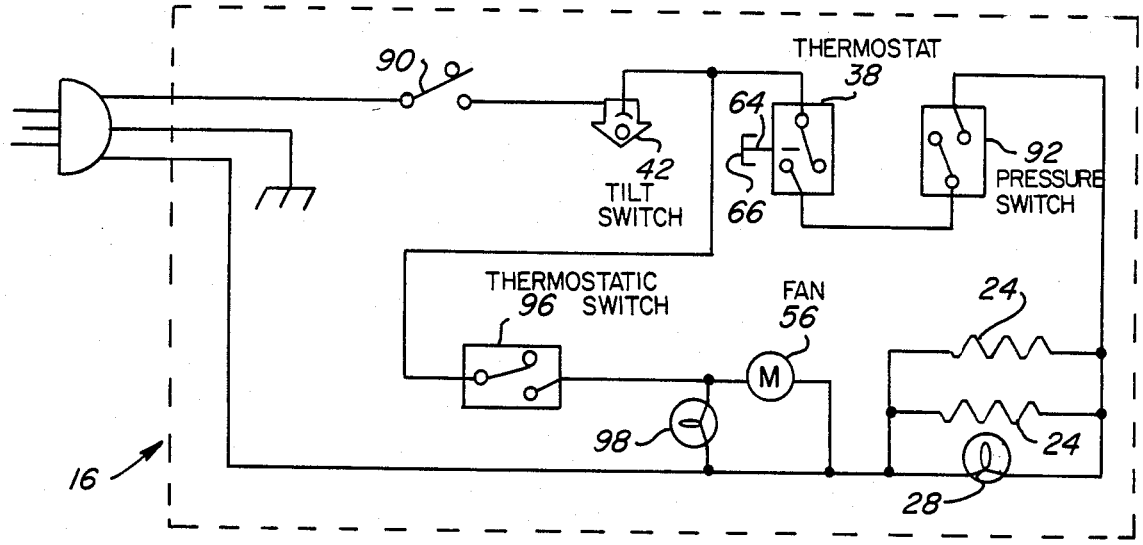
Fig.-8
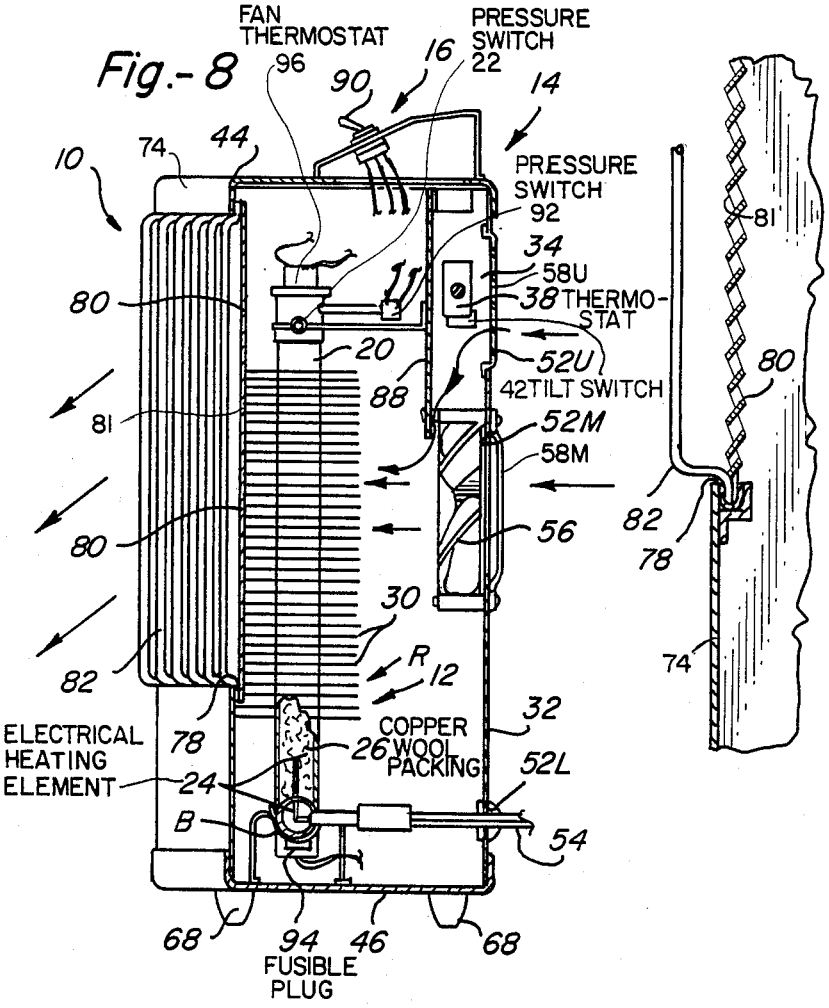
Fig.-9

ELECTRICALLY-POWERED PORTABLE SPACE HEATER

Electrically-powered boilers have been used by others as the heating elements in small portable space heaters. Noteworthy among these prior art heaters are those forming the subject matter of the several Sturgis patents, among which are U.S. Pat. Nos. 3,640,456; 3,927,299; and 4,223,205. The U.S. patent to McNeely teaches the use of a two-phase liquid system as the working fluid and the system is operated at subatmospheric pressures; however, the two liquids are immiscible and different from those which applicants use. Brand et al, on the other hand, teach the use of glycols and other low freezing point liquids in a closed loop system. Decker in his U.S. Pat. No. 1,919,204 even teaches an ethylene glycol/water mixture used in an electrically-fired boiler operated at below atmospheric pressure.

Other U.S. patents known to applicants that relate to the general subject of space heaters, most often of the fin-tubed radiator type are as follows: U.S. Pat. Nos. 1,043,922; 1,289,052; 1,866,221; 1,525,958; 1,913,923; 1,983,437; 2,432,917; 2,509,138; 2,772,342; 3,179,788; 3,281,574; 3,463,904; 3,469,075; and 3,523,180.

Applicants have discovered that, while their mechanism for generating the heat to be supplied to the environment that needs to be heated has much in common with prior art space heaters, the way in which others have delivered and controlled same leave much to be desired. In most of these prior art systems, for example, even those using forced air convection, little is done by way of getting the heat where it is needed. Instead, it is allowed to rise while being blown out in a narrow stream that is ineffective except when occupying a position directly in front thereof. In others, the radiating surfaces are left virtually unprotected or are placed so close to other exposed surfaces heated thereby that there is a danger of being burned. Open flames, flammable fuels, accessible hot surfaces and other hazardous conditions characterize many of the prior art portable space heaters.

Applicants have found that by generating steam from a mixture of ethylene glycol and water, while shielding the heat exchangers, the temperature of all exterior surfaces can be kept at levels well below those which are hazardous while, at the same time, providing enough heat to warm most confined areas of average size if properly picked up and distributed in a stream of forced air. The design of the heater housing is such that the wiring and user-controlled thermostatic components are isolated from the branched and divergent compartments that house twin heat exchangers. By aspirating ambient air from behind the heater into a chimney housing the thermostatic control for the heaters, the system is virtually unaffected by hotspots near the heaters or the flow of warmed air out the front. By splitting the stream of warmed air so that part flows forwardly between the heat exchangers and the rest is diverted sideways alongside the latter, a broad pattern of heated air is directed down along the floor by a louvred screen. Start-up of the heating system is accelerated by automatically delaying the start of the forced air system until the steam loop gets up to its pre-set temperature. Various safety features become automatically operative to shut down the heaters whenever the unit is tilted past a certain point, the pressure in the steam loop gets too high or a pre-set temperature is exceeded. Should these safeguards fail and the boiler overheat, a fused plug will melt and harmlessly dump the few ounces of water and ethylene glycol down into the pan formed by the bottom of the housing. All exterior exposed surfaces are double-walled to keep their surface temperatures at or about that of ordinary hot water out of the household tap or else located so far away from the heat exchangers that they don't get hot in the first place.

It is, therefore, the principal object of the present invention to provide a novel and improved portable electrically-operated space heater.

A second objective is to provide a device of the type aforementioned that has a unique forced air distribution system in which the housing, paired heat exchangers, louvred screen and fan cooperate to spread a curtain of warm air along the floor.

Another object is that of providing a space heater in which ambient air relatively unaffected by hot surfaces inside the heater or hot air discharged therefrom is aspirated into a chimney containing the user-controlled thermostat that governs the temperature of the exiting air.

Still another objective is to provide a time delay system whereby the fan that moves the air past the heat exchangers is prevented from operating until the steam loop gets up to its pre-set operating temperature.

An additional object is the provision of a space heater of the type herein disclosed and includes heat exchange surfaces in the 250° F. range, yet all accessible exterior surfaces remain at all times no hotter than approximately 110° F. even though the heated air entering the environment will be much hotter.

Further objects are to provide a flameless, fuelless, portable space heater totally devoid of accessible surfaces hot enough to cause burns which is simple, lightweight, safe, efficient, rugged, dependable, compact, versatile, easy to operate and even decorative in appearance.

Other objects will be in part apparent and in part pointed out specifically hereinafter in connection with the description of the drawings that follows, and in which:

FIG. 1 is a perspective view of the heater as it would appear looking down thereon from a vantage point above and 45° to the right of the front end thereof;

FIG. 2 is a right side elevation of the heater to the same scale as FIG. 1 and with portions of the side of the housing broken away to expose the interior thereof;

FIG. 3 is a top plan view to the same scale as FIGS. 1 and 2, also having portions of the top broken away to expose the interior;

FIG. 8 is a vertical section taken along line 8—8 of FIG. 3;

FIG. 9 is a greatly enlarged fragmentary section showing the grill and louvred screen covering the hot air discharge opening in front of the heat exchangers; and, FIG. 10 is a schematic wiring diagram of the control circuit for the fan and heaters.

Figure 4:
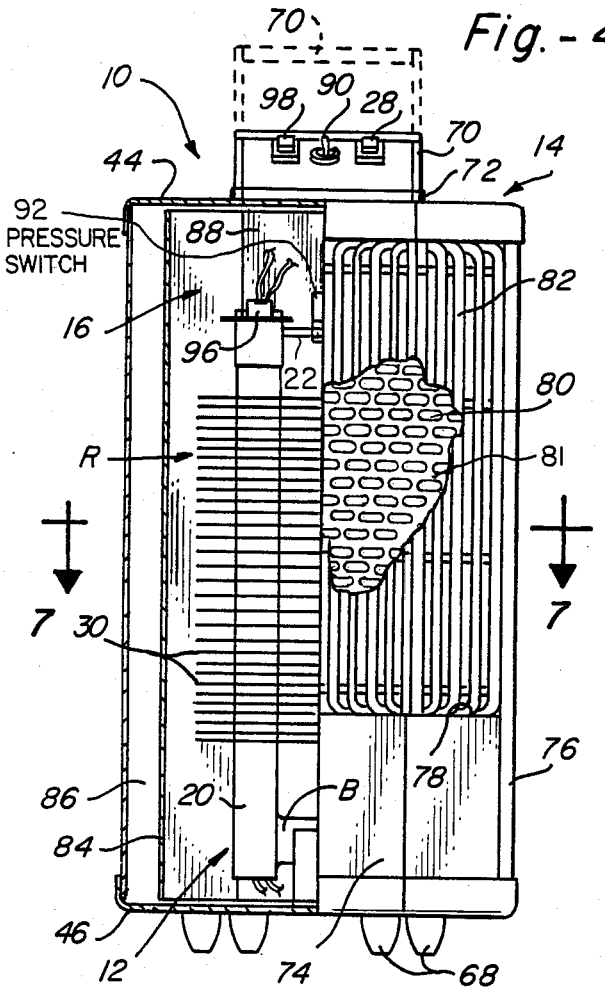
FIG. 4 is a front view half in section and half in elevation, taken along line 4—4 of FIG. 5 and with portions of the grill broken away to expose the louvred screen therebehind.
Figure 5:
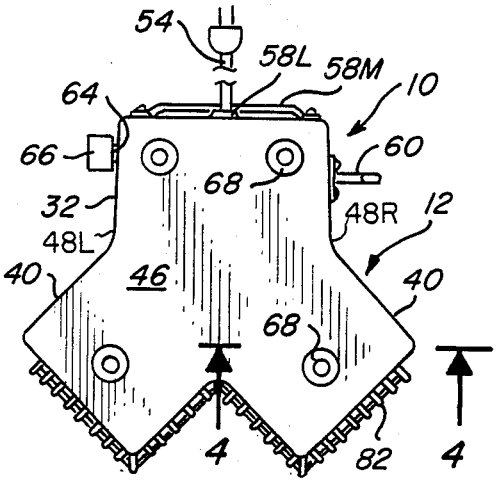
FIG. 5 is a bottom plan view to the same scale as FIGS. 1–4.
Figure 6:
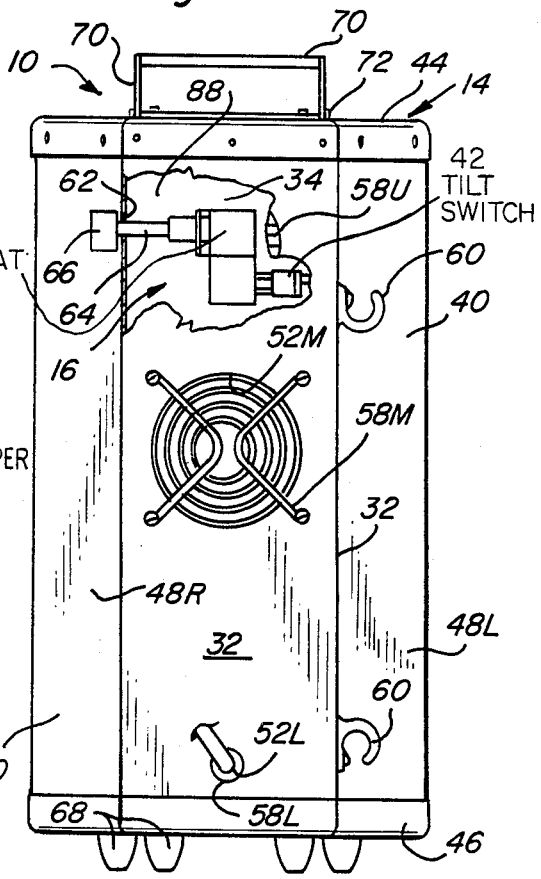
FIG. 6 is a rear elevation, again to the same scale as FIGS. 1–5, and having a portion of the rear panel broken away to expose the elements of the control system housed therebehind.

Referring next to the drawings for a detailed description of the present invention and, initially, to FIGS. 1–7 for this purpose, reference numeral 10 has been selected to broadly identify the space heater of the present invention while numerals 12, 14 and 16 similarly identify the heat source, housing for the latter and control system therefor, respectively. The heat source 12 consists of a horizontally-disposed boiler B opening at both ends into risers 20. Risers 20 are, in turn, connected at their upper ends by a tube 22 which cooperates therewith and with the boiler to define a closed-loop system.

The loop is sealed and operated at a subatmospheric pressure selected such that the water in a 70–30 mixture of water and ethylene glycol will boil at approximately 130° F. Heat is supplied to the boiler by a pair of conventional electrically-powered resistance heating elements 24, one of which is housed in each riser 20 and designed to operate off of ordinary 110 V. alternating current and consume, preferably, somewhere about 400 watts each for a small model and about 750 watts for a larger one. As the ethylene glycol/water mixture boils, "bumping" in the risers is controlled through the use of copper wool 26 as a packing therein (see FIG. 8). A brief look at the schematic of FIG. 10 will reveal that the heating elements 24 are wired in parallel with one another and with a lamp 28 which lights up whenever these elements are operating.

Each riser tube 20 is fitted with a plurality of fins 30 which cooperate therewith in the well-known manner to define heat exchange radiators generally designated by the letter "R". The location of these radiators R relative to one another and to the housing 14 containing same is quite significant and is most clearly revealed in FIGS. 7 and 8 to which detailed reference will now be made. Housing 14 will be seen to have a generally Y-shaped cross section in which the stem-forming portion 32 houses most of the wiring, a very important chimney 34, the blower 56, the thermostat 38 and other elements of the control system 16 including tilt switch 42; whereas, the branches 40 that diverge in right angular relation to one another and at 45° to the aforesaid stem portion 32 primarily house the heat exchangers R along with the remaining elements of the control system which require some physical connection to the latter.

The top 44 of the housing 14 is closed as is the bottom 46 and both sides 48R and 48L. The rear panel 50 of the housing on the other hand, contains three openings, the first 52L for the power cord 54, a second 52M through which room air is drawn by fan 56, and a third 52U near the top opening onto thermostat 38 within chimney 34, all of which are most clearly shown in FIGS. 7 and 8. Both the upper opening 52U and the middle one, 52M, are covered by grills 58U and 58M, respectively, while the lower one, 52L carries the usual cord-protecting grommet 58L. As illustrated, the left side 48L carries the hooks 60 for storing the power cord while the right side 48R has an opening 62 therein (FIG. 6) through which the stem 64 of the thermostat control 66 extends. Rubber feet 68 on the bottom of the unit hold it in spaced relation above the floor and a foldable handle 70 on top is used to carry it from place to place. The hinge axis 72 of the handle extends transversely and is located at the fore-aft balance point of the unit.

With particular reference to FIGS. 1–5, it can be seen that the lower third or so of the front of the unit is covered by a solid panel 74 as are the outside corners by panels 76. The remainder of the front of the unit comprises a large opening 78 covered on the inside by a heat deflecting screen 80 and on the outside by a grill 82.

FIGS. 8 and 9 show that screen 80 is located adjacent the heat exchangers R and is louvred as shown at 81 to deflect the heat downwardly toward the floor as indicated by the arrows to the left of the grill in FIG. 8. Grill 82, on the other hand, is spaced forwardly of the screen which gets quite hot due to its proximity to the fins 20. The sidewalls 48R and 48L also lie in very close proximity to these hot heat exchanger surfaces and, to prevent them from overheating to a degree where someone could get burned, spacer panels 84 are provided that fit along the closed-in sides of the unit so as to leave a dead air space 86 therebetween, that is most easily seen in FIGS. 4 and 7. These panels cooperate with the grill 82 on the front to maintain all the exposed surfaces at a temperature of approximately 110° F. or below even when high wattage heating elements are employed in the boiler.

Figure 7:
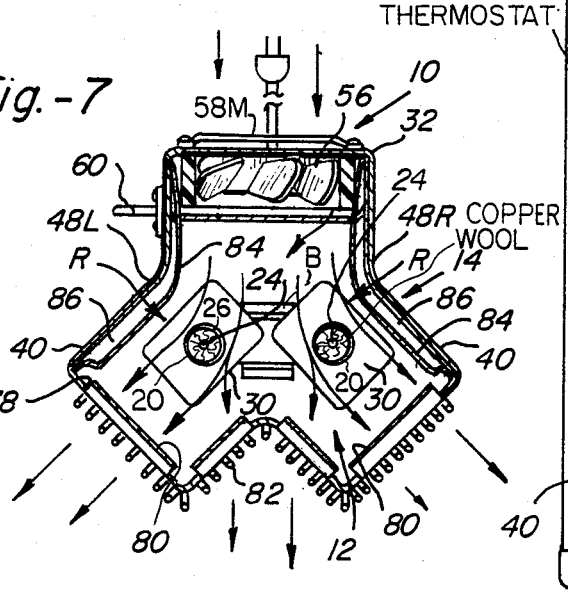
FIG. 7 is a horizontal section taken along line 7—7 of FIG. 4.

FIGS. 7 and 8 show the air flow pattern most clearly and it will be noted that fan 56 lies directly behind the finned heat exchangers R so as to draw in ambient air through opening 52M and force it forwardly between the two risers 20 which are spaced apart on opposite sides thereof. The fins 30 on these risers are angled at approximately 90° relative to one another but oriented in parallel relation to the branches 40 of the Y-shaped housing. As the airstream is impelled forwardly, it is split by the risers as shown such that part of the flow is directed sideways at 45° due to the cooperative action of the riser and spacer plate 84 alongside thereof while the rest of the flow is directed forwardly between the riser tubes. Thus, a gentle flow of warm air is distributed over a 90° angle in front of the heater while, at the same time, being deflected downwardly by the louvred screen 80 cooperating with the unique Y-shaped housing.

One of the most significant features of the heater 10 is that which is most clearly shown in FIG. 8 to which detailed reference will next be made. Extending down from the top 44 of the housing in the stem-forming portion 32 thereof all the way to a level just slightly below the top of the fan 56 is a partition wall 88. Narrow spaces 90 are provided alongside this fan between it and the deflector plates 84 inside the housing as well as in front thereof behind partition wall 88 for the passage of air. In the back wall behind the partition wall and above fan opening 52M is the air intake opening 52U which cooperates with these deflector plates and the partition wall to define the chimney 34. Inside this chimney directly in front of opening 52U is placed the thermostat 38 which, as will appear presently, controls the heating elements 24. Operation of fan 56 aspirates ambient air into the chimney through air intake 52U and draws it down over the thermostat which thus becomes responsive to the ambient conditions present in the space to be heated, not the environment in the branches of the housing in front of wall 88 where the heat exchangers are located. This aspirated air is mixed with that entering through the fan intake 52M and blown across the heat exchangers R along with the hot screen 80 and the spacer panels 84 heated by the latter.

Located as it is within the chimney 34, thermostat 38 responds, as it should, to the ambient air temperature, not that which exists inside the portions of the heater ahead of partition wall 88. This wall is also continuously cooled by the stream of ambient air drawn across it by the fan. At the same time, fan 56 is positioned to blow forwardly directly across and between the heat exchangers where the air picks up heat therefrom and recondenses the steam in the riser tubes allowing it to return to the boiler by gravity flow.

The control system 16 includes, among other things, a number of safety features which are worthy of special mention, most of which are shown in the schematic of FIG. 10 to which reference will next be made. A main on/off switch 90 controls the supply of electrical power to the unit. Connected in series with this on/off switch, is the tilt switch 42 which, in the particular form shown, is mounted in the chimney alongside the thermostat 38. Switch 42 is of conventional construction and is normally closed when the unit is standing upright and essentially level. If, however, it should tilt in any direction at an angle greater than approximately 15°, switch 42 opens and shuts off the power instantly.

In FIGS. 4, 8 and 10, a pressure switch 92 will be seen connected in the same series circuit that includes on/off switch 90, tilt switch 42, thermostatically-controlled switch 38 and the resistance heating elements 24. This pressure switch is connected as shown into the steam loop near the top of one of the risers. It, too, is of conventional design and is normally closed but automatically operative to actuate into open position and shut off the power in the event the pressure exceeds a predetermined limit which, in the present instance, is set at between approximately 28–30 p.s.i., the normally-operative pressure being about 25–30 p.s.i.

Yet another safety feature is revealed in FIG. 8, namely, a fusible plug 94 in the boiler B. In the event the boiler overheats, plug 94 will melt at a temperature of about 350° F. which is less than the flash point of ethylene glycol and let the fluid contained therein drain into the pan defined by the bottom 46 of the housing. The total volume of fluid contained in the boiler (approximately 6 ounces) is such that pan 46 can easily retain same.

The user-controlled thermostat 38 in the chimney 34 has already been discussed in some detail. It is of the variable type having off, low, medium and high heat settings set by the user who turns control knob 66. Such thermostatic controls are well known in the art and, once set, become automatically operative to maintain the selected ambient air temperature.

One of the most significant and unique features of the control system is the thermostatically-controlled time delay that keeps the fan 56 from operating until the boiler gets up to a preselected temperature. Located within the steam loop is a second thermostat 96 seen in the schematic of FIG. 10 along with FIGS. 4 and 8. This thermostat is connected in a branch circuit to the heating elements 24 that bypasses the main user-actuated thermostat 38 and the pressure switch 92. This branch circuit is in series with the main on/off switch 90, tilt switch 42, an indicator lamp 98, the fan 56 and the heaters. Thermostatically-controlled switch 96 is of the normally open type set to close automatically at a predetermined temperature and to reopen again at another predetermined lower temperature. In this particular application, the thermostat is set to close when the temperature in the steam loop reaches approximately 130° F. and to reopen again when it drops down to 110° F.

Assuming the normal start-up condition in which the tilt switch 42 is closed, pressure switch 92 is closed due to a negative pressure in the steam loop and user-controlled thermostat 38 is closed because the room temperature is below that at which the thermostat is set, closure of the main power switch 90 will, of course, energize the resistance heaters 24 and turn on indicator lamp 28. If the fan 56 were to turn on at this point, it would draw ambient air in from the atmosphere and blow it across the heat exchangers R thus preventing the latter from getting up to the operating temperature at which the water in the ethylene glycol/water mixture boils at the subatmospheric pressure; however, by connecting this fan in series with thermostatically-controlled switch 96, the fan will not turn on until such time as the temperature in the steam loop reaches the preselected level of, say 130°. Once this temperature has been reached, the fan will turn on as will the indicator light 98. In those instances where the ambient air temperature is quite cold, i.e. cold enough to drop the temperature in the steam loop below the minimum temperature at which the thermostat is preset, it will reopen and shut off the fan once again. In the low wattage model, an 1800 rpm fan has proved quite adequate, whereas, in the high wattage one, a 3000 rpm fan works better.

One other element has yet to be described, namely, valved vacuum fitting 100 seen in FIG. 3. This fitting communicates the interior of the steam loop and is used to both introduce the working fluid therein as well as evacuate the air therefrom. No novelty is, of course, predicated upon such a feature which is well known in the art.

The unique housing design together with the flow pattern therethrough produce a portable space heater which generates a gentle flow of warm thermostatically-controlled air into the environment. There are no open flames to constitute a fire hazard nor are any combustible fuels used. Instead, a closed loop electrically-powered steam loop supplies the heat at a temperature essentially that of hot water out of a household tap due to the subatmospheric temperatures at which the steam is generated. The double-walled housing provides an air insulation barrier between the heat exchangers and the exterior surfaces closely adjacent thereto sufficient to keep the latter at a maximum temperature of just slightly over 100° F. Any malfunction such as a failure of the heater-control thermostat that results in an excess of pressure in the steam loop will actuate the pressure switch to shut down the system and if, perchance, the latter malfunctions, the fusible plug will melt dumping the contents of the boiler harmlessly into the bottom of the housing. If the unit is accidently knocked over, there is no fuel to spill or flame present to ignite, sear or otherwise harm the materials it falls against. Before the unit can "hit the ground" so to speak, the tilt switch will have actuated to shut off all power to the heating elements but, even if it were to fail and the unit was operating properly, no exterior surface would be hot enough to cause any damage. The unit heats up quickly and delays the flow of heated air until the steam loop is up to temperature, whereupon, the fan turns on and directs a gentle flow of warm air downwardly, forwardly and at 45° to each side straight ahead.

What is claimed is:

1. A space heater which comprises: top and bottom walls, a rear wall and angled sidewalls cooperating with one another in assembled relation to define an open front housing having a generally Y-shaped transverse section with a stem-forming portion at the rear and a pair of divergent branch portions opening toward the front thereof; a horizontally-disposed boiler extending transversely of the housing in the bottom thereof at the juncture between the stem and branched portions; a heat transfer fluid in said boiler containing a vaporizable component; heating means for heating the heat transfer fluid and boiling the vaporizable component thereof; a pair of vertically-disposed spaced heat exchangers mounted, respectively, in the branch portions of the housing and connected to receive hot vapor from the boiler; and a blower located in the stem-forming portion of the housing positioned and adapted to receive ambient air from the environment through an air inlet in said stem portion and direct the same forwardly between the heat exchangers in heat exchange relation thereto, said heat exchangers cooperating with one another and the angled sidewalls of the housing to split off parts of the forwardly-directed airstream and direct the same out sideways through the branch portions, and said diverted parts of the airstream combining with the forwardly-directed part passing between the heat exchangers to produce a spread of heated air at least approximately 90° in angular extent.

2. The space heater as set forth in claim 1 in which: the heat transfer fluid comprises a mixture of ethylene glycol and water; the boiler is operated at a subatmospheric pressure such that the water boils at approximately 130° F.; and the boiler and heat exchangers comprise portions of a closed loop system.

3. The space heater as set forth in claim 1 in which: a louvred screen extends across the open front of the housing, the louvres in said screen being shaped to receive a horizontally-disposed flow of air from the blower and redirect same downwardly at an angle.

4. The space heater as set forth in claim 1 in which: the housing includes curved deflector plates spaced inside each sidewall cooperating therewith to define a dead air space therebetween effective to insulate said sidewalls from the direct heat generated in the heat exchangers.

5. The space heater as set forth in claim 1 in which: each of the heat exchangers comprises a riser tube and a plurality of fin-type radiators stacked on above the other in spaced relation on each riser, said radiators being sized and shaped to substantially fill their respective branch portions of the housing and thus force the majority of the air issuing from the blower to flow therebetween.

6. The space heater as set forth in claim 1 in which: a vertically-disposed partition wall extends transversely of the stem-forming portion of the housing spaced forwardly of the rear wall thereof and hanging down from a position near the top thereof to a level adjacent the top of the blower; the rear wall of the housing has an opening therein opposite said partition wall cooperating therewith to define a chimney isolated from said branch portions into which ambient air from the environment is aspirated by the force flow of air issuing from the blower; and, in which thermostatically-controlled means is connected to the heating means for actuating same at a predetermined temperature, said means including a thermostat housed inside the chimney responsive to the temperature of the ambient air entering same.

* * * * *